United States Patent [19]

Mullett, Jr.

[11] Patent Number: 4,993,254

[45] Date of Patent: Feb. 19, 1991

[54] METHOD AND APPARATUS FOR BENDING MATERIAL

[75] Inventor: John W. Mullett, Jr., Rockledge, Fla.

[73] Assignee: JL Manufacturing, Rockledge, Fla.

[21] Appl. No.: 372,319

[22] Filed: Jun. 28, 1989

[51] Int. Cl.[5] ..... B21D 5/04

[52] U.S. Cl. ..... 72/319; 269/278

[58] Field of Search ..... 72/319–321, 72/458, 388, 387; 269/278, 277, 271

[56] References Cited

U.S. PATENT DOCUMENTS

| | | | |
|---|---|---|---|
| 391,408 | 10/1888 | Fitzberger | 72/321 |
| 1,128,421 | 2/1915 | Diamond | 72/319 |
| 2,838,971 | 6/1958 | Shekter | 269/277 |
| 3,248,921 | 5/1966 | Trout | 72/458 |
| 4,142,395 | 3/1979 | Kelm | 72/319 |

FOREIGN PATENT DOCUMENTS

| | | | |
|---|---|---|---|
| 123093 | 8/1901 | Fed. Rep. of Germany | 72/320 |
| 1188779 | 9/1959 | France | 72/320 |
| 200117 | 12/1938 | Switzerland | 72/387 |
| 541479 | 11/1941 | United Kingdom | 72/319 |

*Primary Examiner*—Daniel C. Crane

*Attorney, Agent, or Firm*—Antonelli, Terry, Stout & Kraus

[57] ABSTRACT

A small, lightweight, portable apparatus for use with a vise permits precise bending of material such as metal and plastic. A base of the apparatus has a size which can be clamped between the jaws of the vise along with a material to be bent. A movable member is connected to the base so that it can be pivoted relative to the base for bending an outwardly extending portion of the material clamped between the jaws of the vise. An adjustable stop on the movable member aids in setting the apparatus with respect to the vise for the particular thickness of the material to be bent.

6 Claims, 3 Drawing Sheets

26
27
25
28
21
9
22
20
29
8
15

30°

18
14
19
16
13
14
23
23
10
11
19
18
17
11
10
14
16
12
14

METHOD AND APPARATUS FOR BENDING MATERIAL

TECHNICAL FIELD

The present invention relates to an apparatus for use with a vise for bending material such as metal and plastic, and to a method of bending material using the apparatus.

BACKGROUND ART

Brakes for bending material such as sheet metal are known. These machines for bending material are large and expensive. Because of their size and weight, they are not easily transported to a job site in the field, for example in a van, and the known machines may be too big and/or expensive for use in a small shop. Thus, when a small sheet metal bending job presents itself in the field or in a small shop, the only option available has been using a vise and a hammer. This is disadvantageous since the hammer distorts the material being bent and it is difficult to obtain a good bend.

Thus, there is a need for a small, inexpensive, relatively lightweight and portable apparatus which can be used for bending sheet metal and other material without distorting the material and while producing precision bends in just a few seconds on a wide range of materials and thicknesses, without use of a hammer.

DISCLOSURE OF INVENTION

An objection of the present invention is to provide an apparatus for use with a vise for bending material such as metal and plastic which solves the aforementioned problems. More particularly, an object of the invention is to provide an apparatus which is small, inexpensive, lightweight and portable but which can be used with a common bench vise to produce precision bends in just a few seconds on a wide range of materials and thicknesses without otherwise distorting the material as with the use of a hammer.

A further object of the invention is to provide a method for bending materials such as metal and plastic using the apparatus of the invention, in combination with a conventional vise, for obtaining precision bends on a wide range of materials and thicknesses without the use of a hammer.

These and other objects are attained by the apparatus of the invention for use with the vise for bending material such as metal and plastic. The apparatus comprises a base of a size which is adapted to be clamped between the jaws of a vise, a movable member, and hinge means for connecting the movable member and the base so that the movable member can be pivoted about the hinge means with respect to the base for bending a material clamped between the jaws of the vise with the base and extending outwardly therefrom. The movable member is connected to the base by the hinge means such that it can be pivoted through an angle of at least 90° with respect to the base between an upright position above the base when the base is clamped between the jaws of the vise to a horizontally extending position over one of the jaws of a vise for bending a material.

In the disclosed, preferred embodiment of the apparatus the base includes two parallel, planar surfaces on opposite sides of the base for facilitating clamping of the base between the jaws of the vise. Both the base and the movable member are elongated in form and substantially coextensive with one another. A hinge is located at each of the two ends of the elongated base for connecting the ends of the base to respective ends of the elongated movable member.

According to a further feature of the invention, the apparatus comprises a stop for engaging with a jaw of the vise during set up and positioning of the apparatus in the vise in accordance with the thickness of the material to be bent. The stop is adjustably mounted on the movable member of the apparatus such that the position of the stop on the member can be adjusted during set up to maintain the proper position of the apparatus relative to the vise as discussed more fully below in connection with the method of the invention. The hinges at the respective ends of the movable member and base are located towards a working side of the base and movable member against which a material to be bent is located when the apparatus and the material are clamped in a vise. The stop is adjustably mounted on a side of the movable member opposite this working side. A handle is connected to the movable member to facilitate moving the movable member to bend a material clamped between the jaws of the vise along with the base of the apparatus.

The method of the invention for bending material such as metal and plastic comprises providing an apparatus which includes a base of a size which is adapted to be clamped between the jaws of a vise, a movable member and hinge means for connecting the movable member and the base so that the movable member can be pivoted about the hinge means with respect to the base for bending a material clamped between the jaws of the vise with the base and extending outwardly therefrom, clamping the base and a material to be bent between the jaws of the vise with the material extending outwardly therefrom and pivoting the movable member about the hinge means with respect to the base to bend the material.

In order to set the apparatus for the thickness of the material to be bent, further according to the method of the invention the material to be bent is placed on top of a jaw of the vise, the movable member of the apparatus placed thereon and the base of the apparatus clamped between the jaws. The movable member is then pivoted to an upright position above the base of the apparatus and the stop adjusted to the top of the opposite jaw of the vise. The jaws of the vise are then loosened and the material to be bent is positioned between the jaw of the vise along with the base while the proper height of the apparatus is maintained by the stop contacting one jaw of the vise. The vise jaws are then clamped tightly on the material and the base of the apparatus. The handle of the apparatus is thereafter pulled to pivot the movable member of the apparatus on its hinges relative to the base to bend the outwardly protruding portion of the material over one the jaws of the vise in a direction away from the apparatus.

The apparatus and method of the invention can be performed with any shop or bench vise and will bend a wide range of materials and thicknesses including copper, brass, beryllium, steel, tool steel, spring steel, stainless steel, silver, tin, bronze, Lexan (plastic), etc. Bends in up to one-eighth inch thick stainless steel can be made with the apparatus of the invention when it is used with a heavy duty vise.

These and other objects, features and advantages of the present invention will become more apparent from the following description when taken in connection with the accompanying drawings, which show, for purposes of illustration only, one preferred embodiment in accordance with the present invention.

BEST MODE FOR CARRYING OUT THE INVENTION

Figures 2A, 2B, 2C, 2D:
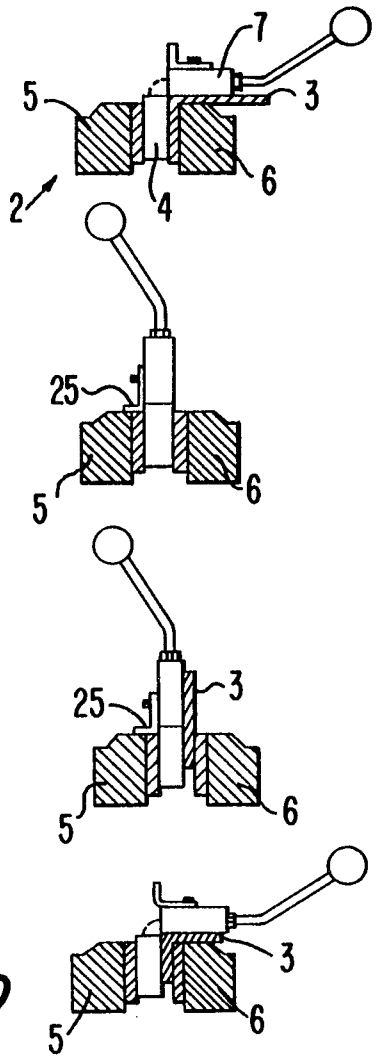
FIG. 2A is an end view of the apparatus of FIG. 1 shown in combination with a vise wherein the base of the apparatus is clamped between the jaws of the vise and a workpiece to be bent is placed on top of one jaw of the vise with the movable member of the apparatus laying on top of the material during set up of the apparatus for bending the material.
FIG. 2B is a view similar to FIG. 2A where the movable member of the apparatus has been pivoted to an upright position above the base and the adjustable stop on the movable member has been lowered to contact a jaw of the vise.
FIG. 2C is a view similar to FIGS. 2A and 2B but showing the material to be bent, which was shown in FIG. 2A on top of one of the jaws of the vise, now clamped between the jaws of the vise with the base and extending outwardly therefrom along the working side of the apparatus.
FIG. 2D is a view similar to FIG. 2C but showing the movable member in a position where it has been pivoted from its upright position over an angle of 90° for bending the material over a one jaw of the vise.
Figure 1:
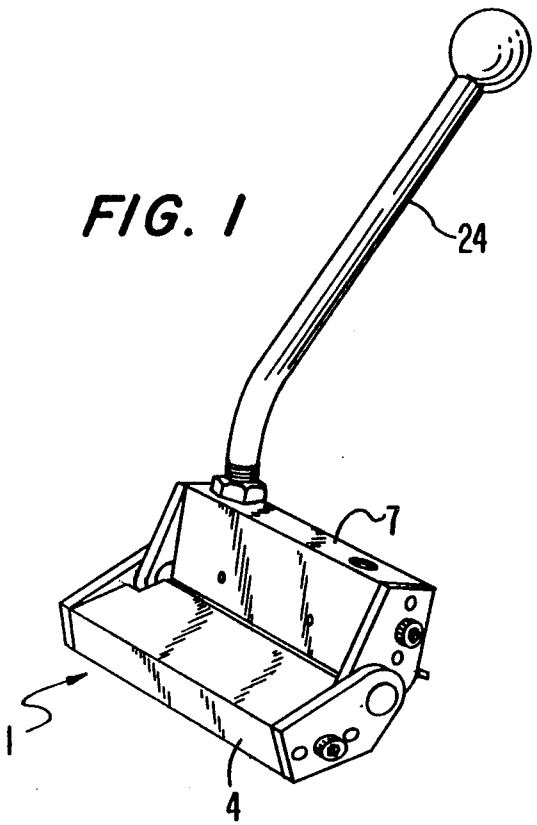
FIG. 1 is a perspective view of a preferred embodiment of an apparatus of the invention for use with a vise for bending material, the working side of the apparatus adapted to engage and press the material to be bent being shown.
Figure 3:
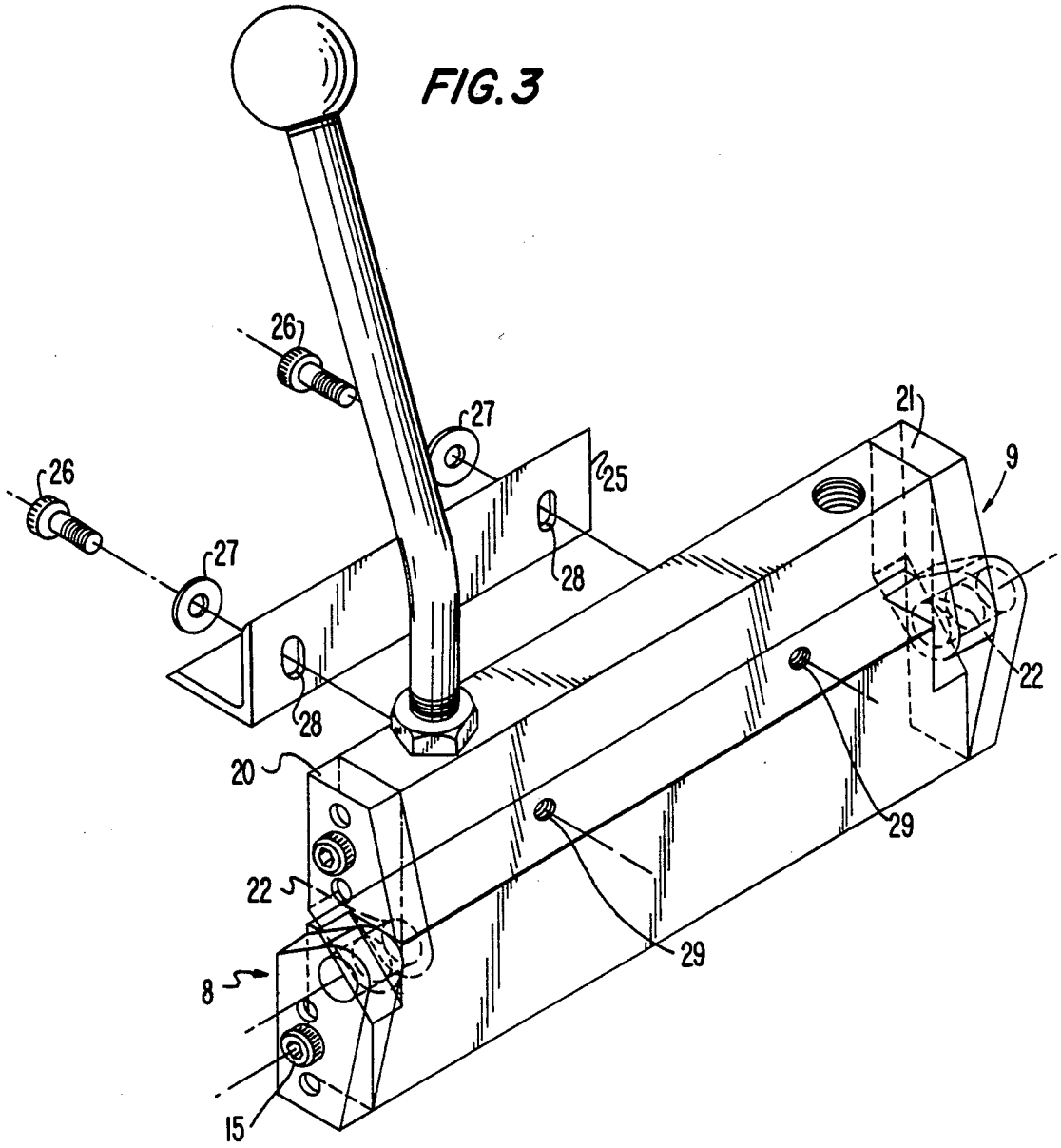
FIG. 3 is another perspective view of the apparatus similar to FIG. 1 but showing the adjustable stop in disassembled relation to the apparatus and also illustrating in more detail the hinge connections at each of the opposite ends of the apparatus.
Figures 4A, 4B:
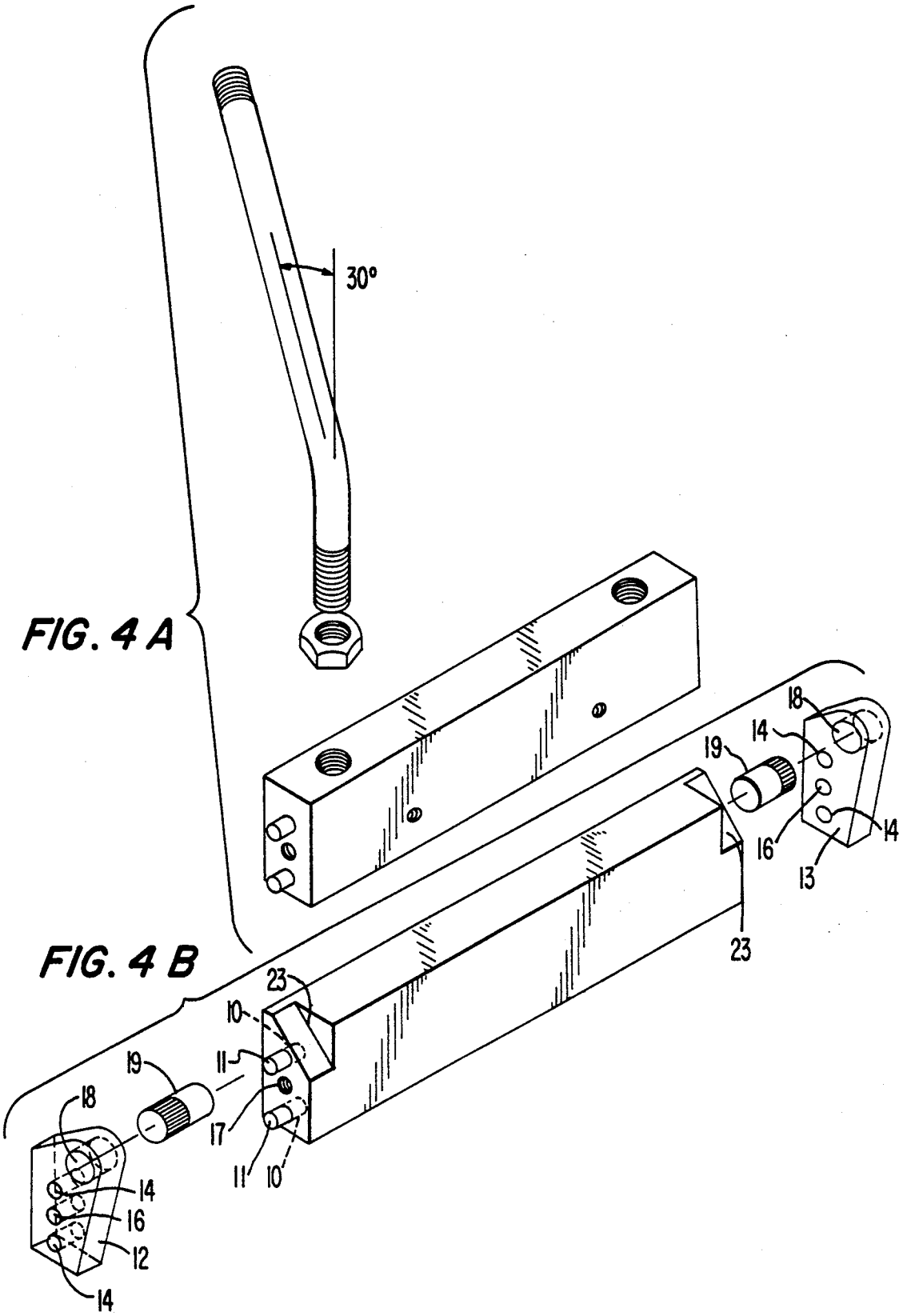
FIG. 4A is a perspective view of the elongated movable member of the apparatus with the handle therefor shown in disassembled relation to the member, the end plates for forming hinged connections with the movable member not being shown.
FIG. 4B is a perspective view of the base of the apparatus with the end plates and hinge pins carried thereby being shown in disassembled relation.

Referring how to the drawings, an apparatus 1 of the invention is for use with a vise 2 for bending a material 3 which may be formed of metal, plastic or other material. The apparatus comprises an elongated base 4 of a size which is adapted to be clamped between the jaws 5 and 6 of vise 2. An elongated movable member 7 is connected at its ends to the base 4 by hinge assemblies 8 and 9 so that the movable member 7 can be pivoted about the hinge assemblies with respect to the base for bending a material clamped between the jaws of the vise with the base so as to extend outwardly therefrom.

The several parts of the apparatus 1 including the base 4 and movable member 7 are precision machined from C1018 cold rolled steel in the preferred embodiment but other materials could be employed which would give the apparatus the necessary strength for bending metal and other materials. The base 4 in the disclosed embodiment has a length of 7 inches, a height of 1.5 inches and a width of 0.750 inch thereby permitting the base to be clamped between the jaws of any shop or bench vise along with a material to be bent. Each end of the base 4 has a pair of holes 10 in vertical alignment for receiving with an interference fit the ends of dowel pins 11. The dowel pins have a diameter of 0.250 inch while the holes 10 have a diameter of 0.249 inch in a disclosed embodiment. The outer ends of the dowel pins 11 are received with a slip fit into corresponding holes 14 in an end plate 12 of hinge assembly 8 and an end plate 13 of hinge assembly 9 for maintaining alignment of the end plates with respect to the base. The end plates 12 and 13 are secured on the ends of the base 4 by means of bolts 15 which extend through holes 16 in the end plates. The threaded ends of the bolts 15 are screwed into the threaded apertures 17 in the ends of the base 4 between holes 10.

Each of the end plates 12 and 13 of the hinge assemblies 8 and 9 has an aperture 18 for receiving one end of a hinge pin 19. The hinge pins received in the apertures 18 have a straight knurl formed thereon and are pressed into the respective apertures with slight interference (0.005 inch) to retain the hinge pins within the end plates of the hinge assemblies. The opposite ends of the hinge pins are smooth for pivotably carrying the movable member 7 by way of end plates 20 and 21 of the hinge assemblies 8 and 9. Specifically, the smooth ends of the hinge pins 19 are received in apertures 22 in the end plates 20 and 21. The upper corners of the base 4 are cut away or knotched as at 23 to provide the necessary clearance for the hinge assemblies.

The hinge assemblies 8 and 9 permit movement of the movable member 7 relative to the base 4 when the base is clamped between the jaws 5 and 6 of the vise 2, back and forth between an upright position as shown in FIG. 2B where the movable member is located immediately above the base 4 clamped between the jaws 5 and 6 with the working sides of the base and movable member being in vertical alignment, to at least the position shown in FIGS. 2A and 2D where the movable member is turned at an angle of 90° with respect to its upright position and the base for bending a material over the jaw of the vise as discussed in more detail hereinafter. In the illustrated embodiment, the movable member can actually be bent through an angle of 160° relative to the base for making bends greater than 90°, if desired. A handle 24 is threadedly connected to the top of the movable member 7 to enable the necessary force for bending a material to be applied to the movable member.

An angle bracket 25 is bolted to the side of the movable member 7 opposite the working side which engages the material to be bent. More specifically, a pair of bolts 26 extend through washers 27, elongated slots 28 in the angle bracket 25 and are threadedly received in apertures 29 in the movable member 7 for adjustably mounting the angle bracket 25 with respect to the apparatus 1. The angle bracket 25 serves as a stop during set up of the apparatus in the vise to bend a material of a particular thickness. The apparatus 1 has a working width of six and one-eighth inches and can be employed for making bends in up to one-eighth inch thick stainless steel, for example, with the use of a heavy duty vise.

The method of the invention for bending materials using the apparatus of the invention is illustrated in FIGS. 2A to 2D of the drawings. Illustratively, to set the apparatus 1 for the thickness of the material 3 to be bent, the material 3 is placed on top of a jaw 6 of the vise 2 and the movable member 7 is pivoted so that it lays atop the material 3. The base 7 of the apparatus is then clamped snuggly in the jaws 5 and 6 of the vise 2. The movable member 7 of the apparatus 1 is then lifted to its upright position as shown in FIG. 2B and the position of the adjustable stop 25 is set so that the angle bracket contacts the top of the vise jaw 5.

The jaws 5 and 6 of the vise 2 are then loosened enough to position the material 3 between the jaws as shown in FIG. 2C. The angle bracket 25 keeps the apparatus 1 at the proper height for making the bend during this positioning. The vise jaws 5 and 6 are tightened to clamp the material 3 between the jaws along with the base 4 of the apparatus so that a portion of the material extends outwardly above the vise along the working side of the movable member 7. The apparatus is now ready to be used to make a bend in the material 3. This is accomplished by pulling the handle 24 to pivot the movable member 7 on the hinge pins 19 relative to the base 4 and vise 2 to form a precision bend in the material 3. The degree of bending can be 90° as shown in FIG. 2D of the drawings or could be less than or greater than 90°. Where the bend is to be greater than 90°, the base 4 and material 3 must be positioned higher relative to the vise 2 to allow bending beyond 90°. Thus, with the apparatus and method of the invention it is not necessary to employ a hammer to obtain precision bends whereby distortion of the material as with the use of a hammer and vise can be avoided. The apparatus is also readily portable in a van, for example, so that it can be taken into the field. The small size and low cost of the apparatus also makes it useful for small shops.

While I have shown and described only one embodiment in accordance with the present invention, it is understood that the same is not limited thereto, but is susceptible to numerous changes and modifications as known to those skilled in the art. Therefore, I do not wish to be limited to the details shown and described herein, but intend to cover all such changes and modifications as are encompassed by the scope of the appended claims.

I claim:

1. An apparatus for use with a vise for bending material such as metal and plastic consisting essentially of a base of a size which is adapted to be clamped between the jaws of a vise, a movable member movable between an upright position located above the base and the jaws of a vise when the base is clamped between the jaws of the vise and a second position where the movable member is turned at an angle of at least 90° with respect to the upright position and the base for bending a material over one of the jaws of the vise, hinge means connecting said movable member and said base so that said movable member can be pivoted about said hinge means with respect to said base between said upright position and said second position when said base is clamped between the jaws of a vise for bending a material clamped between the jaws of the vise with said base, a stop for engaging a jaw of the vise and means mounting said stop on said movable member such that the position of said stop on said movable member can be adjusted to set the apparatus for the thickness of the material to be bent wherein said hinge means is located toward a working side of said base and said movable member against which said material to be bent is located when said base and said material are clamped in a vise, said stop being mounted by said mounting means on a side of said movable member opposite to said working side thereof, and wherein a handle is connected to said movable member for moving the movable member to bend a material.

2. An apparatus according to claim 1, wherein said base includes two parallel planar surfaces on opposite sides of said base for facilitating clamping said base between the jaws of a vise.

3. An apparatus according to claim 1, wherein said base and said movable member are elongated and substantially coextensive with one another.

4. An apparatus according to claim 3, wherein said hinge means connects the two ends of said elongated base to respective ones of the two ends of said elongated movable member.

5. A brake comprising, in combination, a vise and an apparatus for use with the vise for bending materials such as metal and plastic, said vise comprising first and second opposed jaws and means for clamping a workpiece in said vise between said jaws, and said apparatus consisting essentially of a base of a size which is adapted to be clamped between the jaws of the vise, a movable member movable between an upright position located above the base and the jaws of a vise when the base is clamped between the jaws of the vise and a second position where the movable member is turned at an angle of at least 90° with respect to the upright position and the base for bending a material over one of the jaws of the vise, hinge means connecting said movable member and said base so that said movable member can be pivoted about said hinge means with respect to said base between said upright position and said second position when said base is clamped between the jaws of a vise for bending a material clamped between the jaws of the vise with said base, a stop for engaging a jaw of the vise and means mounting said stop on said movable member such that the position of said stop on said movable member can be adjusted to set the apparatus for the thickness of the material to be bent, wherein said hinge means is located toward a working side of said base and said movable member against which said material to be bent is located when said base and said material are clamped in a vise, said stop being mounted by said mounting means on a side of said movable member opposite to said working side thereof, and wherein a handle is connected to said movable member for moving the movable member to bend a material.

6. A method of bending material such as metal and plastic comprising providing an apparatus including a base of a size which is adapted to be clamped between the jaws of a vise, a movable member, and hinge means for connecting said movable member between said base so that said movable member can be pivoted about said hinge means with respect to said base for bending a material clamped between the jaws of a vise with said base and extending outwardly therefrom, locating said base of said apparatus and a material to be bent between the jaws of said vise, and pivoting said movable member relative to said base to bend said material in the direction of one of the jaws of said vise, wherein said step of locating including the stop of setting the position of said apparatus in said vise for the thickness of said material to be bent by setting the material to be bent on top of a jaw of the vise, pivoting said movable member with respect to said base so that said movable member lays on top of said material to be bent with said base located between the jaws of the vise, clamping said base between said jaws of the vise, pivoting said movable member to an upright position above said clamped base, adjusting the position of an adjustable stop secured to said movable member so as to contact the top of a jam of the vise, loosening said jaws, positioning said material to be bent between the jaws of said vise with said base while maintaining the position of said apparatus with respect to said vise by means of said stop engaging a jaw of the vise, and clamping said material to be bent and said base between said jaws of the vise.

* * * * *